US008439775B2

(12) United States Patent
Stephenson

(10) Patent No.: US 8,439,775 B2
(45) **Date of Patent: *May 14, 2013**

(54) SOCCER TRAINING APPARATUS AND METHOD

(76) Inventor: William A. Stephenson, St. Petersburg, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/553,871

(22) Filed: Jul. 20, 2012

(65) Prior Publication Data

US 2012/0283048 A1 Nov. 8, 2012

Related U.S. Application Data

(63) Continuation of application No. 12/770,852, filed on Apr. 30, 2010, now Pat. No. 8,246,494, which is a continuation-in-part of application No. 12/015,383, filed on Jan. 16, 2008, now abandoned.

(51) Int. Cl.
*A63B 63/00* (2006.01)

(52) U.S. Cl.
USPC ..... 473/477

(58) Field of Classification Search ..... 473/446, 473/494, 454, 447, 445, 435, 422; 280/292
See application file for complete search history.

(56) References Cited

U.S. PATENT DOCUMENTS

| | | | | | |
|---|---|---|---|---|---|
| 675,453 | A * | 6/1901 | Sturgess | 280/292 |
| 693,379 | A * | 2/1902 | Davis | 280/292 |
| 1,160,079 | A * | 11/1915 | Hunter | 280/203 |
| 2,820,269 | A * | 1/1958 | Wolff | 24/9 |
| 2,991,524 | A * | 7/1961 | Dobrikin | 24/371 |
| 4,559,677 | A * | 12/1985 | Tracy | 24/300 |
| 4,694,541 | A * | 9/1987 | Skyba | 24/301 |
| 4,729,576 | A * | 3/1988 | Roach | 280/493 |
| 4,817,551 | A * | 4/1989 | Matson | 114/230.15 |
| 4,977,860 | A * | 12/1990 | Harwell | 119/794 |
| 5,816,458 | A * | 10/1998 | Yonenoi | 224/182 |
| 6,202,263 | B1 * | 3/2001 | Harker | 24/300 |
| 8,246,494 | B2 * | 8/2012 | Stephenson | 473/446 |

FOREIGN PATENT DOCUMENTS

GB 2454181 * 10/2007

* cited by examiner

*Primary Examiner* — Gene Kim
*Assistant Examiner* — M Chambers
(74) *Attorney, Agent, or Firm* — GrayRobinson, PA

(57) ABSTRACT

A soccer training apparatus comprises a net capable of being placed in a deployed position, connected to or located adjacent a soccer goal frame and above a soccer playing surface, so as to cover a portion of a target opening bounded by the soccer goal frame and soccer playing surface. The net includes a peripheral edge located relative to the soccer goal frame so as to form a gap which extends around the net in the deployed position. which permits a soccer ball to pass through and enter the soccer goal area.

9 Claims, 14 Drawing Sheets

1/14

SOCCER TRAINING APPARATUS AND METHOD

CROSS-REFERENCE TO RELATED APPLICATIONS

This application is a continuation of U.S. patent application Ser. No. 12/770,852 filed Apr. 30, 2010 entitled "Soccer Training Apparatus and Method" which is a continuation-in-part application of U.S. patent application Ser. No. 12/015,383 filed Jan. 16, 2008 and entitled "Soccer Training Apparatus and Method." The foregoing applications are expressly incorporated herein by reference in their entirety to form part of the present disclosure.

FIELD OF THE INVENTION

This invention relates generally to sports training equipment and, more particularly, to an apparatus and method for a training soccer players to kick a ball past a goalkeeper.

DESCRIPTION OF THE STATE OF THE ART

In soccer, also referred to in many countries as football, a free kick at the goal is given to a team when a player on the opposite team commits certain types of fouls. A place kick is a type of free kick given at the location of the foul. During a place kick, a lined-up barrier of three to seven defenders can be positioned near the goal to help the goalkeeper in his defense and to block as much of the kicker's view of the goal opening as possible. The goalkeeper need not remain on the goal line before the ball is kicked. A penalty kick or "PK" is another type of free kick. A penalty kick is given to a team when the player of the opposite team commits the foul within the player's penalty area. The free kick at the goal is given from a penalty mark located 12 yards out (or less for youth players under certain ages) with only the goalkeeper to stop the shot. During a penalty kick, the goalkeeper must stay on the goal line until the ball is kicked, but he or she can move laterally along the goal line.

Devices have been developed to train soccer players to direct shots into selected target areas within the goal opening. During a place kick, the kicker should take into account the distance, if any, a goalkeeper is positioned in front of the goal line. A deficiency of many conventional training devices is that they cannot be positioned to simulate a goalkeeper standing in front of the goal line. Another problem is that many convention training devices do not simulate many limitations of a goalkeeper's reach, that the goalkeeper will sometimes fail to stop a shot within reach, and that the goalkeeper will sometimes stop a shot that is typically out of reach. For example, many conventional devices do not allow for the possibility of a shot just below the entire length of the horizontal crossbar of the goal, just inside the entire length of the vertical side posts, and at the corners of the goal. A goalkeeper is less likely to stop a shot in these areas compared to the center of the goal.

Accordingly, there is a need for a soccer training apparatus and method that trains players to score a shot by simulating the reach of a goalkeeper standing on the goal line and/or a goalkeeper standing at a distance in front of the goal line. There is also a need for a soccer training apparatus and method that simulates the limitations of a goalkeeper's reach relative to the horizontal crossbar of the goal and/or along the vertical side posts. There is a further need for a soccer training apparatus and method that simulates real-world situations in which shots that are typically out of a goalkeeper's reach will sometimes fail to score and shots that are typically within the goalkeeper's reach will sometimes score. The present invention satisfies these and other needs.

SUMMARY OF THE INVENTION

Briefly and in general terms, the present invention is directed to a soccer training apparatus and method that involves simulation of a goalkeeper.

A soccer training apparatus, according to aspects of the present invention, comprises a net capable of being placed in a deployed position, connected to or located adjacent a soccer goal frame and above a soccer playing surface, so as to cover a portion of a target opening bounded by the soccer goal frame and soccer playing surface. The net includes a peripheral edge located relative to the soccer goal frame so as to form a gap which extends around the net in the deployed position. Such gap has a size sufficient to allow a soccer ball to pass through and enter the soccer goal area.

In one presently preferred embodiment, the bottom edge of the net is provided with weights to assist in holding it in place relative to the playing surface. A number of hooks may secure the net to the horizontal cross bar of the goal frame, and a number of connectors may extend between the sides edges of the net and the vertical side posts of the goad frame.

In another embodiment of this invention, the net has a height dimension equal to approximately one-half of the height of the goal opening. The net is movable between an upper position adjacent the horizontal cross bar of the goal where it is held in place by hooks and connectors leaving the bottom half of the goal opening exposed, and a lower position adjacent to the playing surface where it is held in place by connectors and the upper half of the goal opening is exposed.

BRIEF DESCRIPTION OF THE DRAWINGS

The structure, operation and advantages of the subject invention will become further apparent upon consideration of the following description, taken in conjunction with the accompanying drawings, wherein.

DETAILED DESCRIPTION OF THE INVENTION

Figure 1:
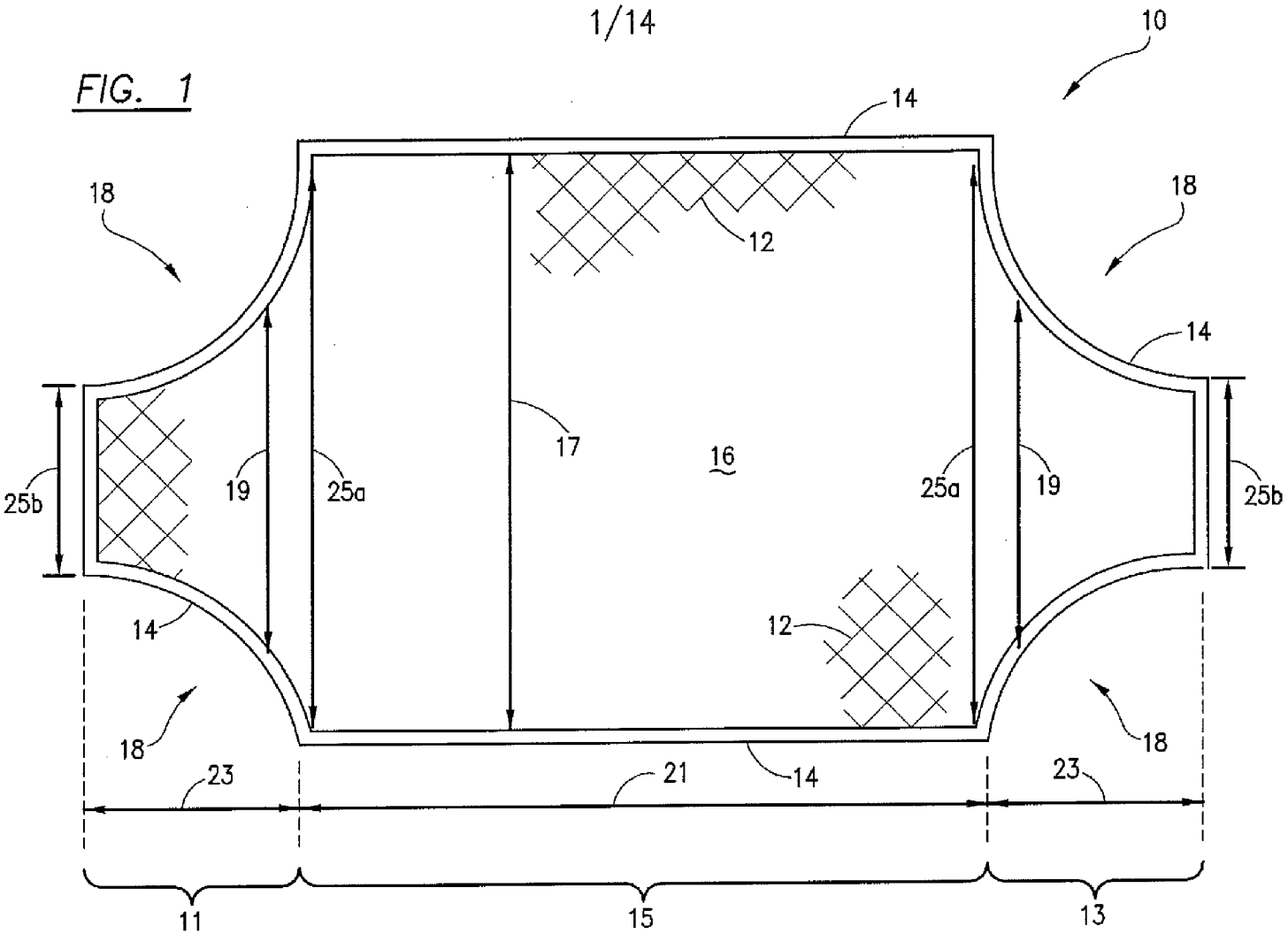
FIG. 1 is a front view of a soccer training apparatus according to an embodiment of the present invention, showing a net defining a blocking area having the general shape of a cross.

Referring now in more detail to the exemplary drawings for purposes of illustrating embodiments of the invention, wherein like reference numerals designate corresponding or like elements among the several views, there is shown in FIG. 1 a soccer training apparatus 10 that includes a net 12 having a peripheral edge 14. Preferably, though not necessarily, the apparatus 10 is collapsible to facilitate storage when not in use. The apparatus 10 is shown in an outstretched, deployed configuration in which the peripheral edge 14 defines a generally cross-shaped blocking surface area 16. The net 12 extends across the entire blocking surface area 16, although the net is only partially shown for ease and clarity of illustration.

The generally cross-shaped blocking surface area 16 simulates the reach of a person acting as goalkeeper. The blocking surface area 16 has cutouts or recesses 18 at the top and bottom corners. The shape and location of the recesses 18 on the blocking surface area 16 correspond to areas where the goalkeeper is less likely to stop a soccer ball from entering a soccer goal area. In the illustrated embodiment, the recesses 18 have the shape of a quadrant of an ellipse and have curved edges so that the blocking surface area 16 is eight sided. In other embodiments, the recesses 18 can be triangular, rectangular, or have another shape so that the blocking surface area 16 has additional corners and more sides.

Referring again to FIG. 1, the net 12 includes a first side portion 11, a second side portion 13, and a middle portion 15 disposed between the first and second side portions. The middle portion 15 has an overall vertical dimension 17 that is greater than average vertical dimensions 19 of the first and second side portions 11, 13. The middle portion 15 also has an overall horizontal dimension 21 that is greater than overall horizontal dimensions 23 of the first and second side portions. Thus, it will be appreciated that the middle portion 15 covers an area greater than the first and second side portions individually.

In the illustrated embodiment of FIG. 1, the overall vertical and horizontal dimensions 17, 21 of the middle portion 16 are equivalent or substantially equivalent to 1.5 meters (5 feet) and 2.7 meters (9 feet), respectively. The overall horizontal dimension 23 of the first and second side portions 11, 13 is equivalent or substantially equivalent to 0.8 meters (2 feet, 6 inches). The vertical dimension 25 of the first and second side portions 11, 13 varies from the outer edge to the inner edge of the side portions 11, 13. For the first and second side portions 11, 13, the vertical dimension 25*a* at the inner edge is equivalent or substantially equivalent to 1.5 meters (5 feet), and the vertical dimension 25*b* at the outer edge is equivalent or substantially equivalent to 0.4 meters (1 foot, 4 inches).

In other embodiments, the net 12 can have other dimensional sizes. For example, a soccer training apparatus designed for small children can have dimensional sizes that are less than what is specified above. As a further example, a soccer training apparatus can have dimensional sizes greater than what is specified above to simulate a goalkeeper with a greater reach.

The net 12 can be made of any number of materials, including but not limited to bungee cords, shock cords, or other elastic cords arranged in a mesh; knotted rope or cords made of synthetic or natural fibers; and combinations thereof. The net 12 can have a high visibility color, such as red, so that the blocking surface area 16 and the gap surrounding it are more easily discernable from a distance. Preferably, though not necessarily, the net 12 is elastic so that it stretches and absorbs impacts from a moving soccer ball or player. In the illustrated embodiment, the net 12 is taught and fully stretched when the apparatus is in the deployed configuration so that a soccer ball rebounds to the soccer field after hitting the net. In other embodiments, the net 12 can be loose so that the soccer ball does not rebound to the soccer field after hitting the net.

The peripheral edge 14 can also be made of any number of materials, including but not limited to bungee cords or other elastic cords, metal rods or tubing, metal cabling, rigid or semi-rigid plastic strips, rope, webbing, and combinations thereof. Preferably, though not necessarily, the material used at the peripheral edge 14 is made of a heavier gauge or thicker material or has a greater tensile strength than the material used for the net 12. In this way, the shape of the blocking surface area 16 can be maintained by securing only a few areas of the peripheral edge 14 to a goalpost, stakes in the soccer playing surface, and/or other support structure. In other embodiments, peripheral edge 14 is just the outer boundary of the net 12 and does not include any material in addition to the net itself.

In the embodiment of FIG. 1, the peripheral edge 14 is made of a bungee material of sufficient thickness to maintain its elasticity with prolonged use outdoors. The bungee material includes one or more elastic strands forming a core that is covered by a woven sheath usually of nylon or cotton. Use of the bungee material gives the net a compliant peripheral edge. The compliant peripheral edge 14 on the net 12 increases the probability that a moving soccer ball will continue into the goal opening 26 when the ball contacts the peripheral edge with sufficient speed. Thus, it will be appreciated that the peripheral edge 14 simulates the real-world situation where, due to the flexibility of the goalkeeper's outstretched fingers, the goalkeeper is sometimes unable to block a shot within his or her reach.

Figure 2:
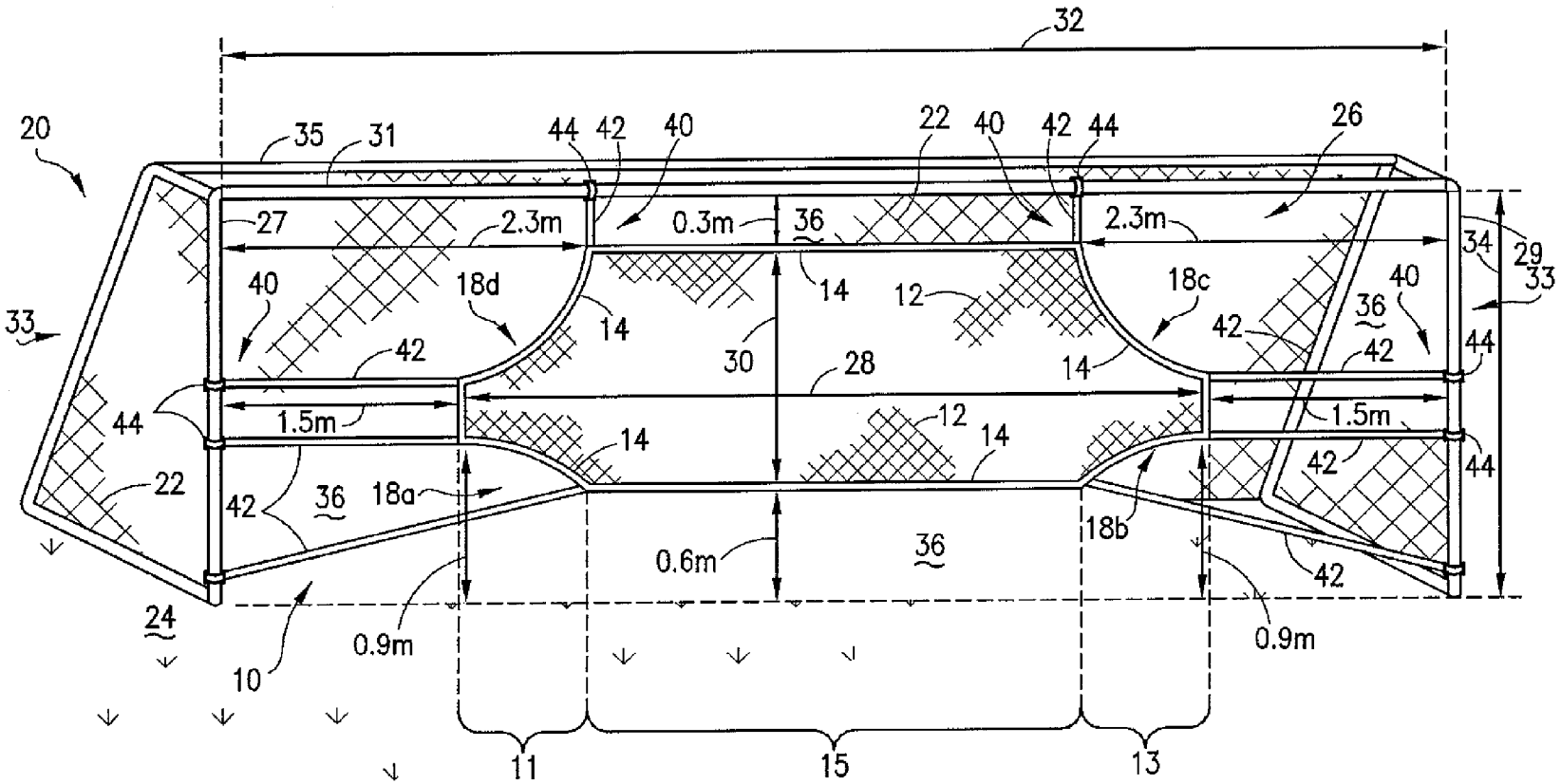
FIG. 2 is a front perspective view of the soccer training apparatus of FIG. 1 showing the net secured to a goal frame with cords and straps.

Referring next to FIG. 2, a soccer goal frame 20 with goal netting 22 is shown on a grass field or soccer playing surface 24. The goal opening 26 is located at the front of the goal frame 20 and is defined by spaced, vertical side posts 27 and 29 connected to one another by a horizontal cross bar 31. A generally C-shaped support 33 is connected to each side post 27, 29 for stability, and the supports 33 are connected to one another by a second cross bar 35. The goal netting 22 is connected to the supports 33 and second cross bar 35 along the sides and rear of the goal frame 20. The goal opening 26 has a generally rectangular shape bounded by the soccer playing surface 24, the vertical side posts 27, 29 and the horizontal cross bar 31 of the goal frame 20. For soccer games with adult players, the goal frame 20 is typically sized so that the goal opening 26 is 2.4 meters (8 feet) high by 7.3 meters (24 feet wide).

In use, the net 12 can be placed in a deployed position so as to cover a central portion of the goal opening 26. The net 12 has a maximum or overall width 28 and a maximum or overall height 30. The overall width 28 and height 30 of the net 12 are less than the width 32 and height 34, respectively, of the goal frame 20 and goal opening 26. In the illustrated embodiment, the overall width 28 and height 30 are equivalent or substantially equivalent to 4.3 meters (14 feet) and 1.8 meters (5 feet, 10 inches), respectively. Applicant has found that these overall dimensions accurately represent the reach of the typical goalkeeper. In other embodiments, the overall width 28 and height 30 can have other dimensions.

Still referring to FIG. 2, a stabilizing device 40 is connected to the net 12. The stabilizing device 40 is adapted to keep the net in the deployed position with respect to the goal frame 20 and playing surface 24. In the illustrated embodiment, the net 12 is aligned with the plane defined by the vertical side posts 27, 29 of the goal frame 20. In this manner, the apparatus 10 simulates a goalkeeper during a penalty kick. During a penalty kick, the goalkeeper is allowed to move laterally or side to side, but must remain on his goal line, facing the kicker, between the side posts 27, 29 until the ball has been kicked.

Instead of being used to block the goal, the apparatus 10 can also be used as a mini-goal during a short-sided game in which there are less than eleven players per team. In short-sided games, the size of the goal is typically smaller than the standard goal size of 7.3 meters (24 feet) wide by 2.4 meters (8 feet) high. Conventionally, cones or pylons are used to demarcate the reduced width of the mini-goal in short-sided games; however, cones and pylons fail to demarcate the reduced height of the mini-goal. The net of a soccer training apparatus of the present invention can be used to demarcate the reduced width and height of the mini-goal in a short-sided game. Thus, it will be appreciated that the soccer training apparatus of the present invention is useful in a variety of situations.

With continued reference to FIG. 2, alignment of the net 12 with the vertical side posts 27, 29 is maintained by the stabilizing device 40, which includes a plurality of cords 42 and straps 44 adapted to be attached to the goal frame 20. The peripheral edge 14 of the net 12 includes a plurality of corners and each one of the cords 42 is attached to a different one of the corners. In this manner, the net 12 can be placed in tension and the peripheral edge 14 maintains its shape during use. The cords 42 and straps 44 can be made of elastic materials, metal cabling, nylon or polypropylene rope or webbing, combinations thereof, and other materials. To facilitate rapid attachment to and detachment from the goal frame 20, the straps 44 can include Velcro closures, other hook-and-loop devices, cam type or slide release buckles, double D-rings, ratchet devices, hooks, and clips.

The cords 42 can be extended across selected segments of the gap 36 to reduce the probability that a soccer ball moving toward the gap will enter the goal. In this manner, the cords 42 can be used to simulate real-world situations where the goalkeeper is sometimes able to stop a ball at distant regions of the goal opening 26 next to the side posts and crossbar.

The peripheral edge 14 is dimensioned to allow a gap 36 to extend entirely around the net 12 such that the gap 36 separates the net 12 from the side posts 27, 29 and cross bar 31 of the goal frame 20, and from the playing surface 24. The gap 36 varies in size along the peripheral edge 14, as discussed below, but in every segment of the gap 36 its size is sufficient to allow a soccer ball to pass through and enter the target area 26. When the apparatus 10 is used with a standard soccer ball, which typically has a diameter of about 23 centimeters (9 inches) or less, the gap 36 preferably extends more than 23 centimeters (9 inches) above, below, and to both sides of the peripheral edge 14.

In the deployed position shown in FIG. 2, the gap 36 extends 0.6 meter (2 feet) below and 0.3 meter (1 foot) above the middle portion 15, and at least 1.5 meters (5 feet) laterally to the side of the first and second side portions 11, 13. The gap 36 is larger at the recesses 18 of the blocking surface area 16. At the bottom recesses 18*a*, 18*b*, the gap 36 extends at least 0.9 meters (3 feet) downward to the playing surface 24 and at least 2.3 meters (7 feet, 6 inches) laterally to the side posts 27, 29. At the top cutouts 18*c*, 18*d*, the gap extends at least 1.1 meters (3 feet, 8 inches) upward toward the horizontal cross bar 31 and at least 2.3 meters (7 feet, 6 inches) laterally to the side posts 27, 29. Applicant has found that a peripheral edge 14 surrounded by the above specified gap 36 is optimal for training a kicker to score during a penalty kick.

Figure 3:
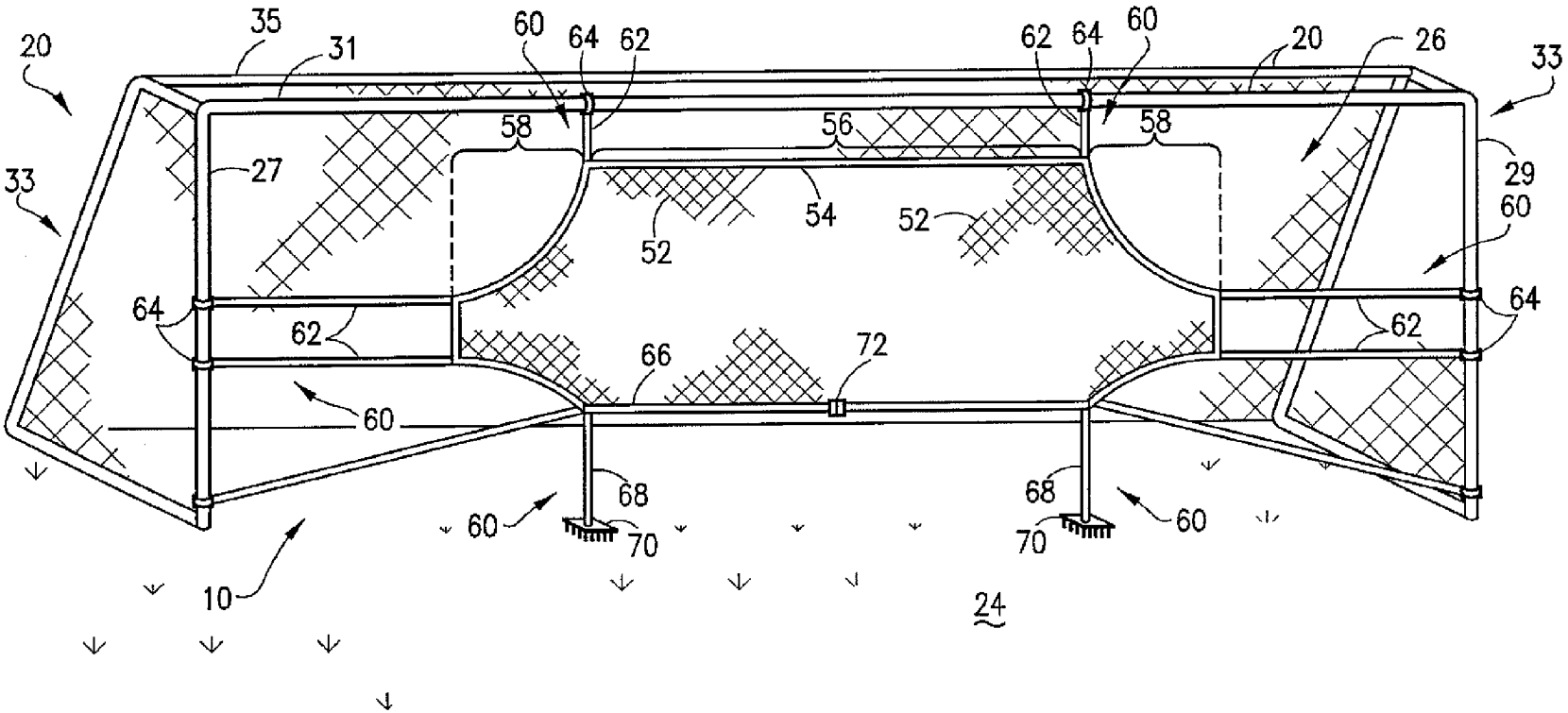
FIG. 3 is a front perspective view of a soccer training apparatus according to another embodiment of the present invention, showing a net attached to a goal frame with cords and straps and kept above the soccer field by a horizontal rod supported by leg members.

In FIG. 3, there is shown another embodiment of a soccer training apparatus 50 having a net 52 and peripheral edge 54 similar to the embodiments of FIGS. 1 and 2. The apparatus 50 is installed on the goal frame 20 so that the net 52 lies on the plane defined by the vertical side posts 27, 29 of the goal frame 20. The net 52 has a middle portion 54 disposed between two side portions 58. A gap 59 is formed between the peripheral edge of the net 52 and the side posts 27, 29, the cross bar 31 and the playing surface 24. The dimensions of gap 59 are approximately the same as those of gap 36 described above in connection with a discussion of FIG. 2.

The apparatus 50 also includes a stabilizing device 60 that comprises a plurality of cords 62 with straps 64. The stabilizing device 60 also includes a horizontal rod 66 and two leg members 68. The horizontal rod 66 and leg members 68 can be made of the same or different type of structure and material. Suitable structures and materials include without limitation solid rods, hollow tubing, extrusions, metal, plastic, wood, and fiber reinforced composites.

The rod 66 is attached to the bottom edge of the middle portion 54 of the net 52. Each of the leg members 68 has an end attached to the rod 66 and an opposite end attached to a bed of spikes 70 insertable into grass field or other type of soccer playing surface 24. The bed of spikes 70 includes a platform that helps to keep the leg members 68 from sinking into the playing surface 24. In this way, the dimensions of the gap 59 below and above the net 52 is maintained. Preferably, though not necessarily, the rod 66 is made of a rigid material, such as metal tubing, to better maintain the net 52 in its deployed position in relation to the goal frame 20. To facilitate storage of the apparatus 50 after use, the rod 66 can include a centrally located joint 72 to allow the rod 66 to be folded in half.

In other embodiments, the stabilizing device 60 includes additional cords that have one end attached to the ends of the rod 66 and/or the lowest corners of the net 52. The opposite end of the cords can be attached to the goal frame 20 or stakes secured in the playing surface 24. The additional cords would help keep that apparatus 50 from lifting off the playing surface 24 due to impacts from a soccer ball or due to upward tension provided by other cords 62 that hold the net 52 upright.

Referring next to FIGS. 4-8, there is shown an embodiment of a soccer training apparatus 80 maintains its position relative to the goal frame 20 without necessarily being connected to the goal frame. The apparatus 80 has a net 82 and a stabilizing device 86.

Figure 4:
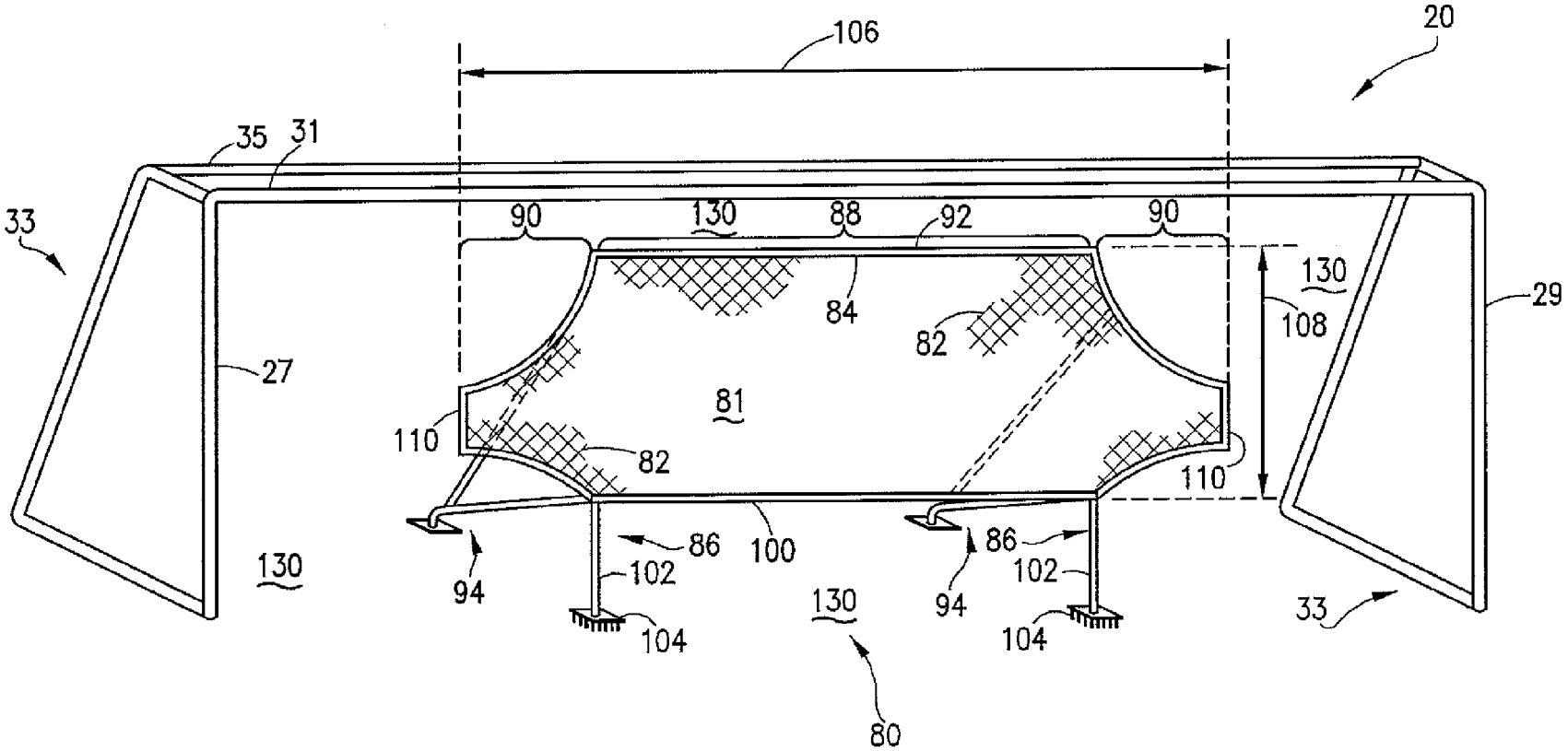
FIG. 4 is a front perspective view of a free-standing soccer training apparatus according to yet another embodiment of the present invention, showing a stabilizing device that includes a net frame and braces extending backwards from the net frame, the net frame encompassing a net in a first deployed position in which the net is aligned with vertical side posts.

In FIG. 4, the net 82 is shown in a first deployed position. The net 82 has a blocking plane 81 bounded by a peripheral edge 84 on its perimeter. The net 82 is centered between the vertical side posts 27, 29 of the goal frame 20 and lies on the plane defined by the vertical side posts 27, 29. In this manner, the net 82 can be used to simulate the reach of a goalkeeper during a penalty kick.

Figure 5:
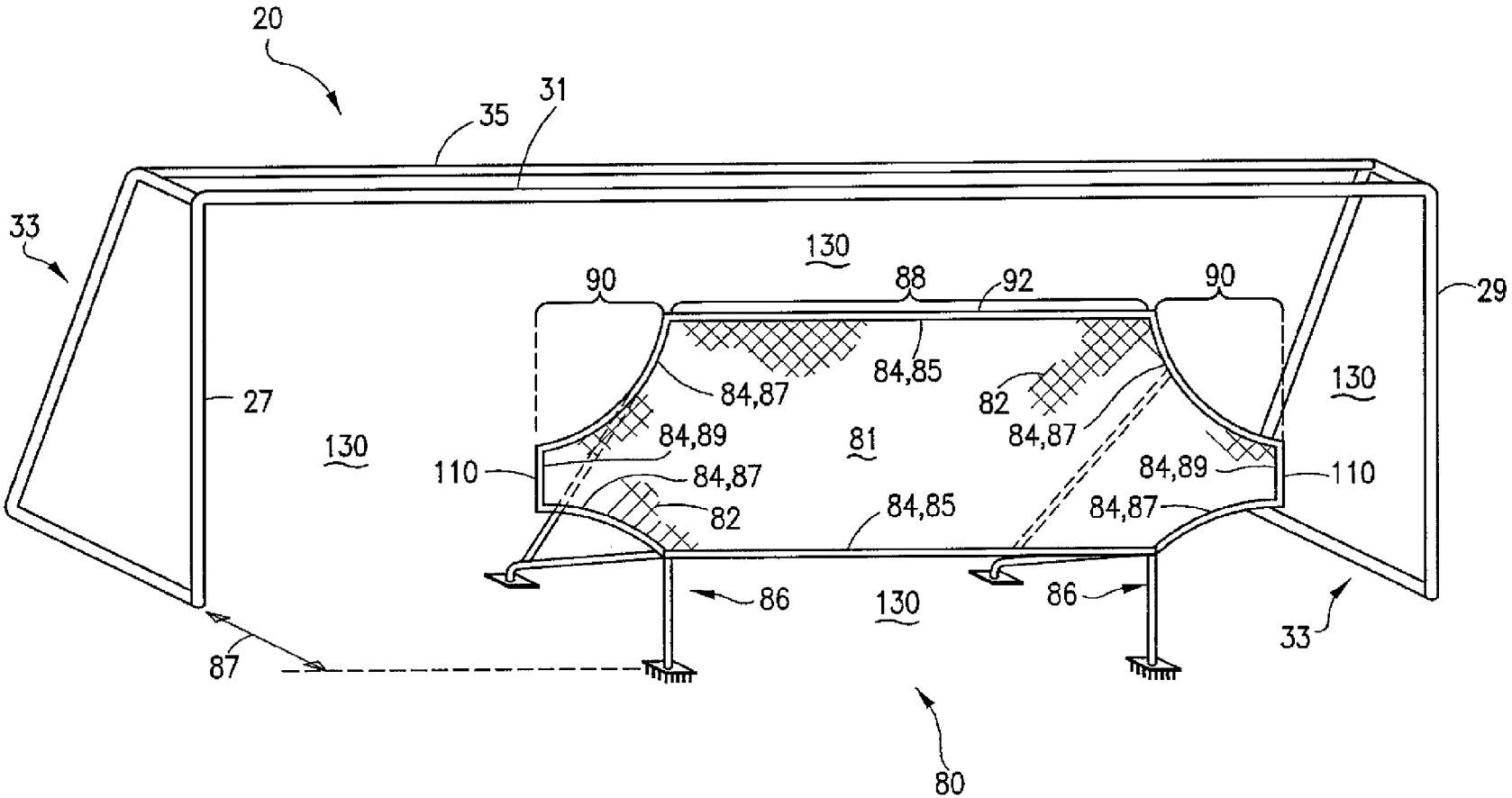
FIG. 5 is a front perspective view of the free-standing soccer training apparatus of FIG. 4 showing the net in a second deployed position at a forward distance in front of the side posts.
Figure 6:
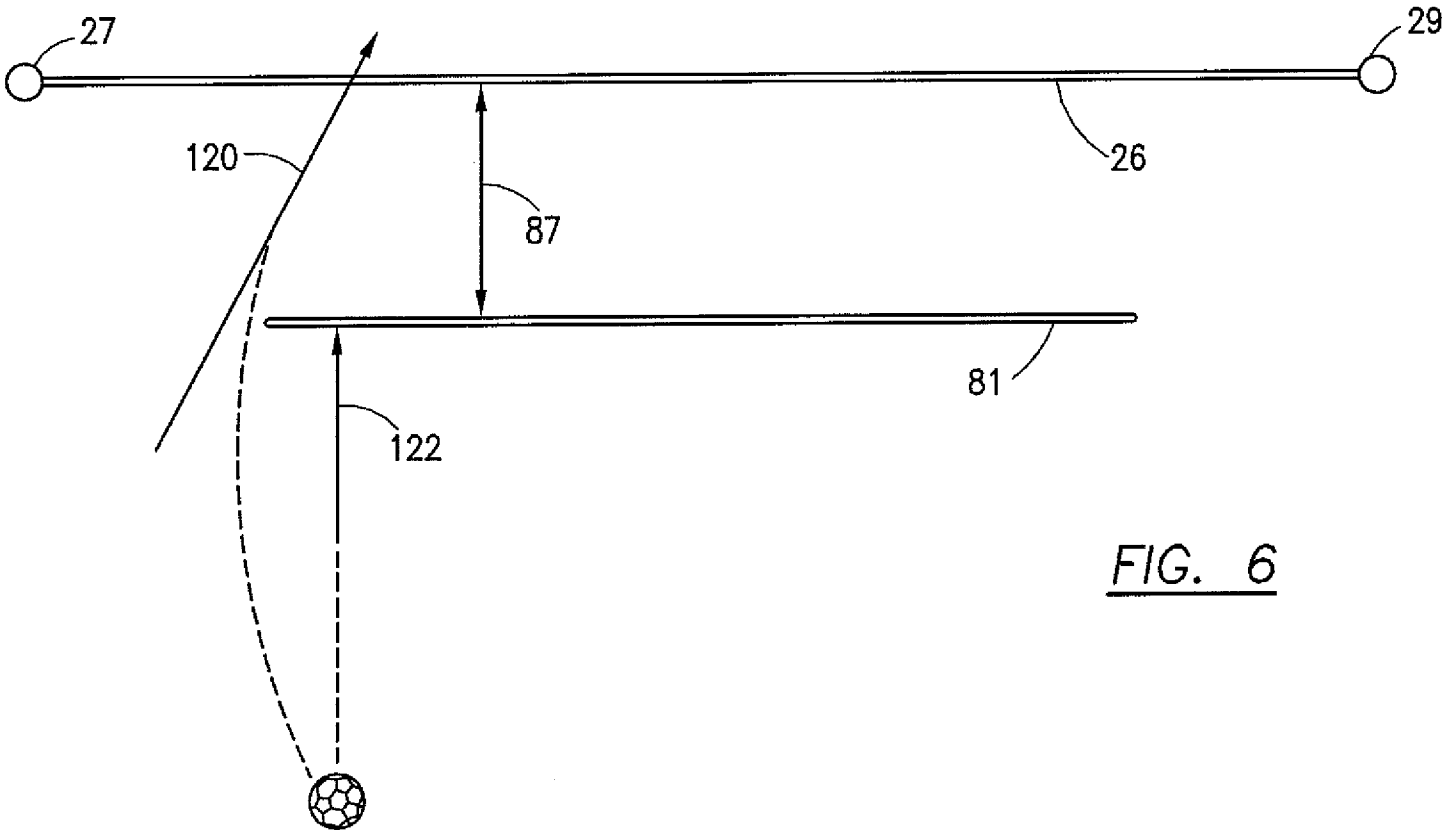
FIG. 6 is a schematic, plan view of the free-standing soccer training apparatus of FIG. 4 showing the net in the second deployed position in front of the side posts and showing how a soccer ball can be kicked in one of two directions relative to a blocking plane of the apparatus.
Figure 8:
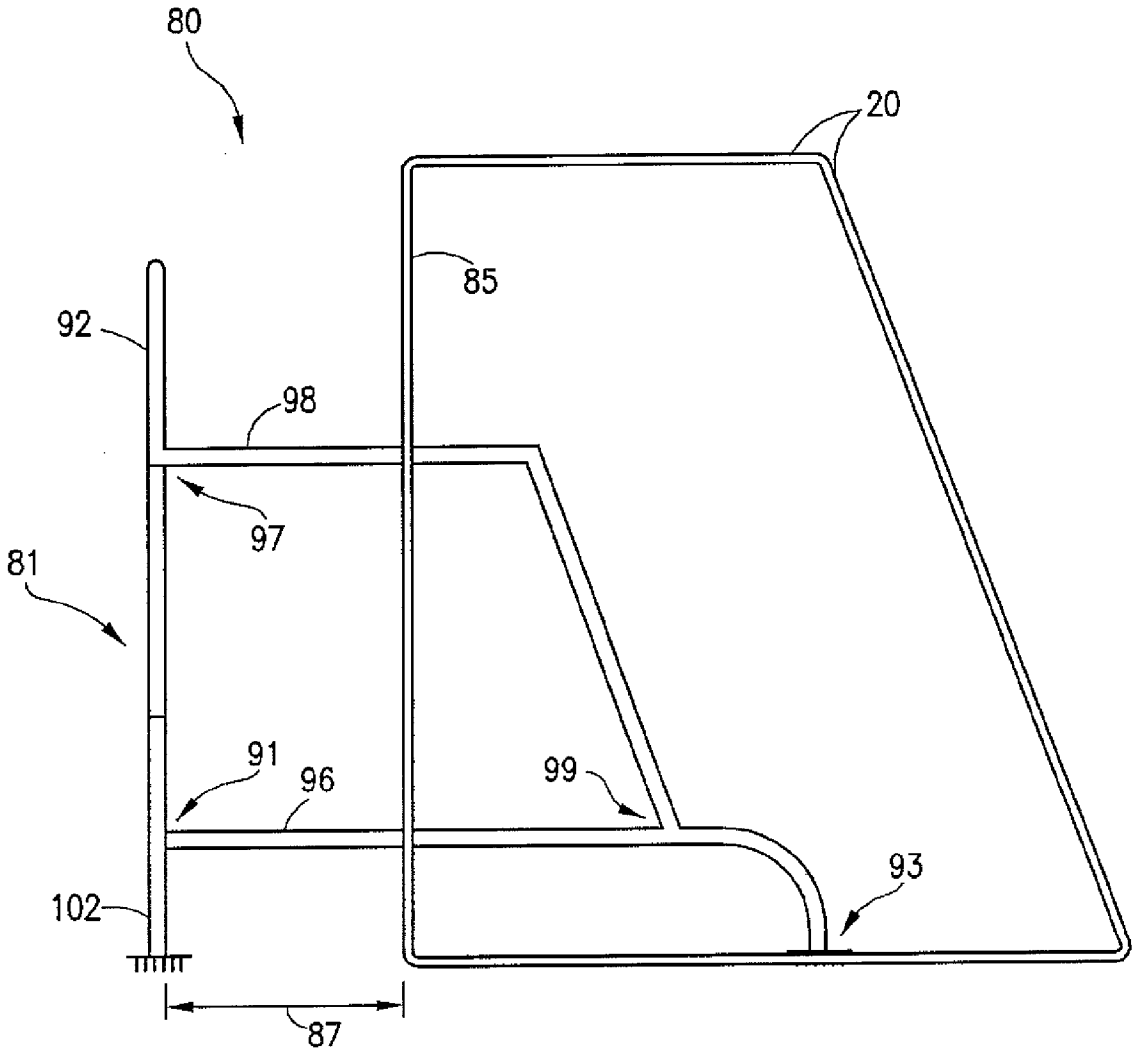
FIG. 8 is a side view of the free-standing soccer training apparatus of FIG. 4 showing the net at the second deployed position in front of the side posts.

In FIGS. 5, 6, and 8, the net 82 is shown in a second deployed position. The net 82 is not necessarily centered between the vertical side posts 27, 29 and is positioned ahead or in front of the plane defined by the side posts 27, 29. In the second deployed position, a forward distance 87 separates net 82 and from the side posts 27, 29. In this manner, the net 82 is used to simulate the reach of a goalkeeper during a free kick or place kick.

During a place kick, the goalkeeper is not required to remain on the goal line before the ball is kicked. The goalkeeper can be in front of the goal line and/or closer to one of the side posts 85, depending on where the ball is located in preparation for the place kick. The soccer training apparatus 80 can easily be moved to any position in front of the goal frame 20 to simulate the reach of a goalkeeper during a place kick.

As shown in FIG. 6, a ball that travels in a slanted or oblique direction 120 to the blocking plane 81 is more likely to enter the goal than a ball that travels in a direction 122 perpendicular to the blocking plane 81. Thus, the apparatus 80 can be positioned in front of the goal frame 20 to train a kicker to direct the ball in direction that is most likely to enter the goal. During training, the forward distance 87 can be selected to create any desired separation between the net 82 and the side posts 85 and goal opening 26 it make it more or less difficult for a kicker to score. That is, the forward distance 87 can be selected so that a ball moving toward the gap will have a lesser probability of entering the goal area when moving in a direction perpendicular to a blocking plane 81 defined by a peripheral edge of the net than in an oblique direction relative to the blocking plane.

Referring again to FIG. 5, the net 82 includes a middle portion 88 disposed between two side portions 90. The middle portion 88 has horizontal top and bottom edges 85, and each of the side portions 90 has arcuate top and bottom edges 87 and a vertical side edge 89.

Figure 7:
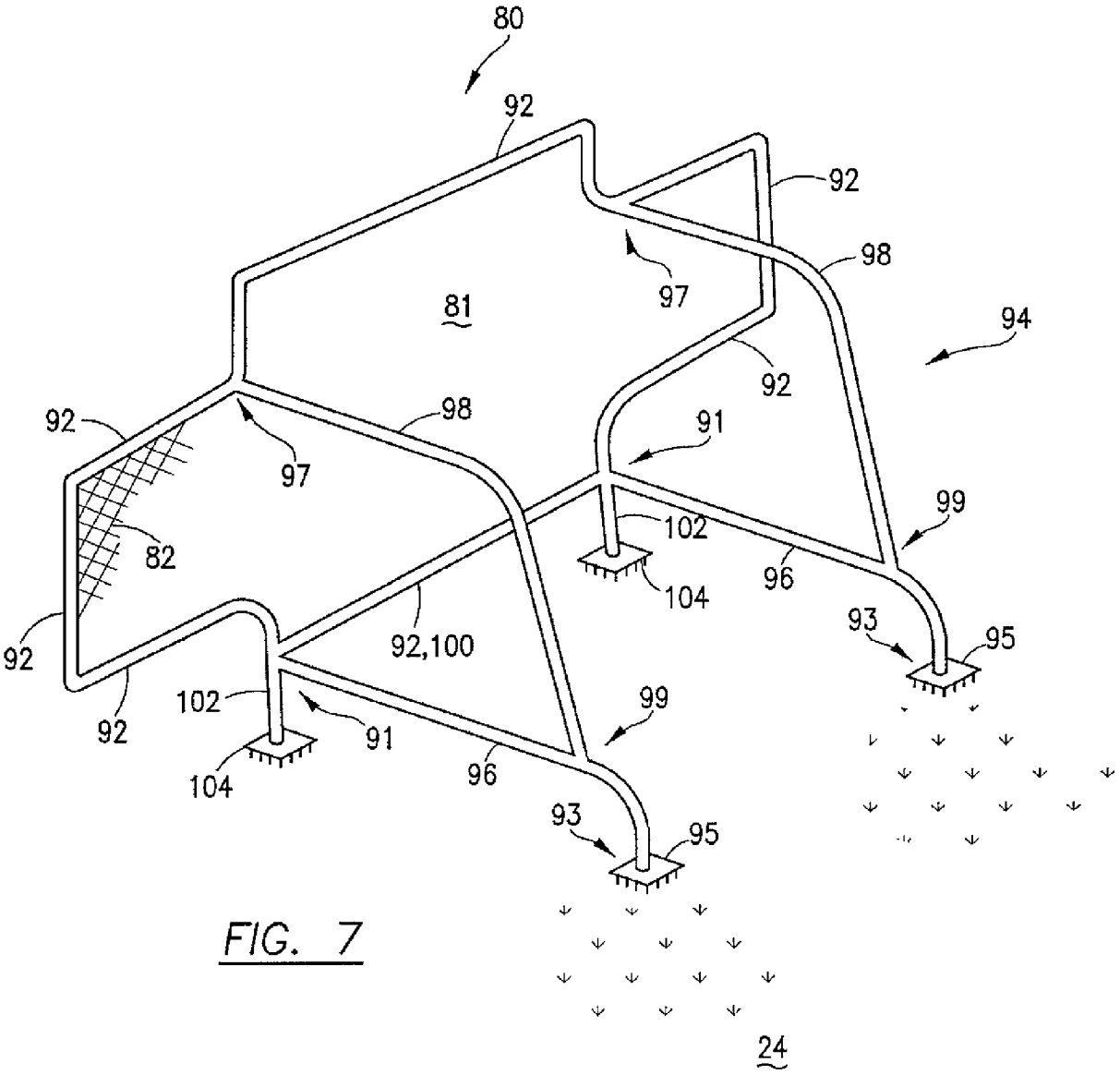
FIG. 7 is a rear perspective view of the free-standing soccer training apparatus of FIG. 4 showing the net stabilized by braces extending rearward from the blocking plane and supported by a bed of spikes for maintaining the net at any distance in front of a goal.

The stabilizing device 86 includes a net frame 92 attached to the peripheral edge 84 of the net 82. Preferably, though not necessarily, the net frame 92 extends around the entire perimeter of the net 82, as shown in FIGS. 4, 5, and 7. The stabilizing device 86 also includes two rear braces 94 attached to the net frame 92. The braces 94 extend in a rearward direction away from a blocking plane 81. To facilitate storage when not in use, the braces 94 can be attached to the net frame 92 with a hinge to allow the braces to fold flat with the net frame. In other embodiments, only one or more than two braces can be employed.

As shown in FIGS. 7 and 8, each of the rear braces 94 includes a lower rod 96 and an upper rod 98. The lower and upper rods 96, 98 are generally elongate in shape and can be made of the same or different type of structure and material. Suitable structures and materials include without limitation solid rods, hollow tubing, extrusions, metal, plastic, wood, and fiber reinforced composites. The lower rod 96 has a coupled end 91 connected to the net frame 92 and a free end 93 capable of engaging the soccer playing surface 24. The free end 93 can include a bed of spikes 95 to keep the apparatus 80 from slipping backwards when the net 82 is hit from the front. The upper rod 98 has a first coupled end 97 attached to the net frame 92 and second coupled end 99 attached to the lower rod 96.

The stabilizing device 86 also includes a horizontal rod 100 and two leg members 102. The horizontal rod 100 forms a part of the net frame 92 and is attached to the entire bottom edge of the middle portion 88. Each of the leg members 102 has an end attached to the rod 100 and an opposite end attached to a bed of spikes 104 insertable into grass or other type of soccer playing surface.

Referring again to FIGS. 4 and 5, a gap 130 extends completely around the net 82 when the net is in the deployed position at the goal frame 20. The gap separates the net frame 92 from the goal frame 20 and playing surface 24 by sufficient distances to allow a soccer ball to enter the goal from above, below, and both side of the net 82. In the illustrated embodiment, the leg members 102 are sized such that the gap extends 0.3 meter (1 foot) below the middle portion 92, which is smaller than the 0.6-meter gap below the middle portion of the embodiment shown in FIG. 2. The smaller size of the bottom gap simulates the decreased likelihood that the kicker can make a shot during a place kick (FIGS. 5, 6, and 8). During a place kick, the kicker is typically further away from the goal than during a penalty kick, so the goalkeeper has more time block a shot.

Referring once again to FIG. 4, the net frame 92 has an overall horizontal dimension 106 and an overall vertical dimension 108 that are equivalent or substantially equivalent to 4.3 meters (14 feet) and 1.8 meters (5 feet, 10 inches) respectively. In this manner, with a standard goal frame having an inside dimension of 7.3 meters (24 feet) wide by 2.4 meters (8 feet) high, the apparatus 50 can be centered such that the outer-most side edges 110 of the net frame 92 are 1.5 meters (5 feet) from the vertical side posts of the goal frame 20. Also, the 1.8-meter overall vertical dimension of the net is greater than the 1.5-meter overall vertical dimension of the embodiment shown in FIG. 2. The greater overall size of the net simulates the increased reach of the goalkeeper during a place kick (FIGS. 5, 6, and 8). As previously mentioned, the goalkeeper typically has more time to react during a place kick as compared to a penalty kick.

In other embodiments, the overall vertical dimension of the net can be greater than 1.8 meters so that the top edge of the net is taller and closer to the horizontal crossbar of the goal as compared to the top edge of the embodiment shown in FIG. 2. In FIG. 2 the top edge of the net is at 2.1 meters (7 feet) above the ground and 0.3 meters (1 foot) below the goal crossbar. During training, a taller top edge enables a kicker to visualize a narrow zone into which he or she should kick the ball during a place kick. During a place kick (FIGS. 5, 6, and 8), the goalkeeper can be six yards in front of the goal line, which provides an opportunity to score a shot even though the goalkeeper typically has more time to react as compared to a penalty kick. By aiming at the narrow zone located slightly below the goal cross bar 31, a kicker can learn to kick the ball along a trajectory that breaks or curves upward out of the goalkeeper's reach then downward into the goal. Applicant has found that aiming at the narrow zone provided by the top edge of the net is a better alternative to using only the goal cross bar 31 as a visual aid because aiming at the cross bar 31 often causes kicker to shoot the ball too high.

Figure 9:
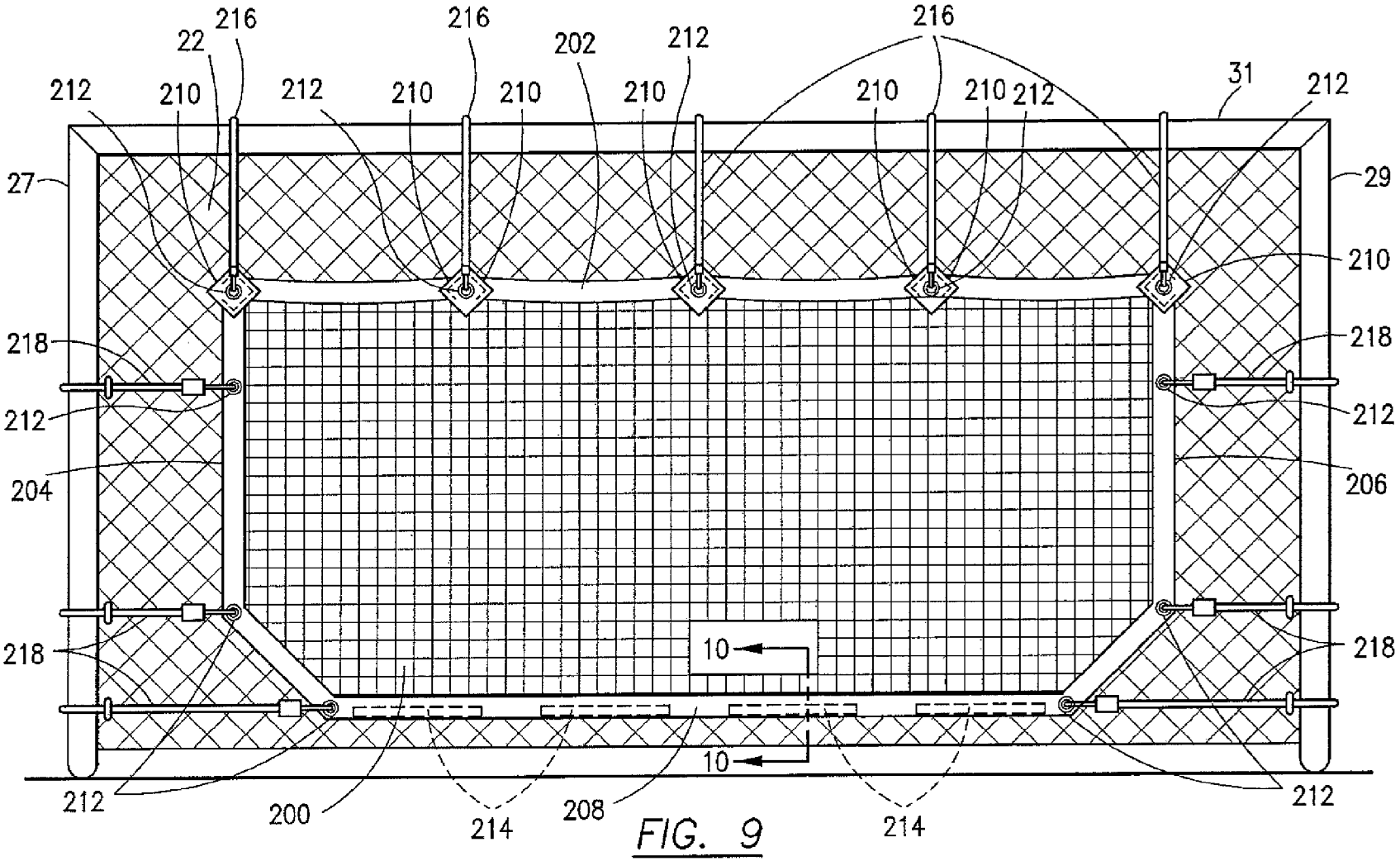
FIG. 9 is front view of a still further embodiment of this invention employing hooks at the top edge of the net, side straps and a sleeve along the net bottom within which weights are mounted.
Figure 10:
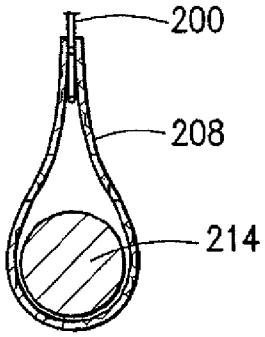
FIG. 10 is a cross sectional view taken generally along line 10-10 of FIG. 9 showing one of the weights in the bottom sleeve of the net.

Referring now to FIG. 9, a still further embodiment of the soccer training device of this invention is depicted. The training device includes a net 200 having a periphery forming top, bottom and side edges. The top edge is connected to a top strap 202, the side edges mount opposed side straps 204, 206 and the bottom edge is connected to a bottom strap 208. Each of the straps 202-208 may be formed of fabric, nylon or other suitable material which is folded in half and sewn, glued or otherwise connected to the net 200. A series of spaced patches 210, each formed of a fabric or plastic material, are connected to the top strap 202 and mount an eyelet 212. The side straps 206 and 208 also mount eyelets 212 in the position depicted in FIG. 9. In the presently preferred embodiment, a number of weights 214 are located at spaced intervals within the bottom strap 208. See FIG. 10. The weights 214 may take the form of bars, plates or the like and function to enhance the rebounding of a ball when it contacts the net 200. In order to limit sagging of the net 200, the weights 214 may be progressively lighter from the sides of the net 200 toward its center.

Figure 11:
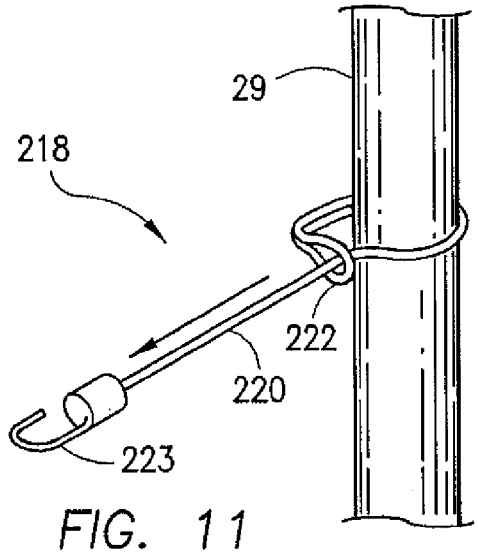
FIG. 11 is a perspective view of a connector coupled to a side post of the goal.

The net 200 is held in place relative to the goal opening 26 by a number of hooks 216 and connectors 218. As best seen in FIG. 11, each connector 218 comprises a length of cord 220, which may be made of the same material as cord 42 described above, having a loop 222 at one end and a fastener 223 at the opposite end. Each connector 218 is affixed to a side post 27, 29 of the goal as shown in FIG. 11 and its fastener 224 is extended into engagement with one of the eyelets 212 in the side straps 204 or 206 of net 200. Preferably, the net 200 has a width dimension such that the connectors 218 are taught when connected to the net 200 leaving a space between the side straps 204, 206 and side posts 27, 29 which is large enough to allow a soccer ball to pass through. Further, the height dimension of the net 200 relative to the goal opening 26 defines a space between the cross bar 31 and top strap 202, and a space between the playing surface 24 and bottom strap 208, to allow for the passage of a soccer ball into the goal opening 26. For purposes of the present discussion, the term "width" refers to a direction between the side posts 27, 29 and the term "height" refers to a direction between the cross bar 31 and playing surface 24.

Figure 13:
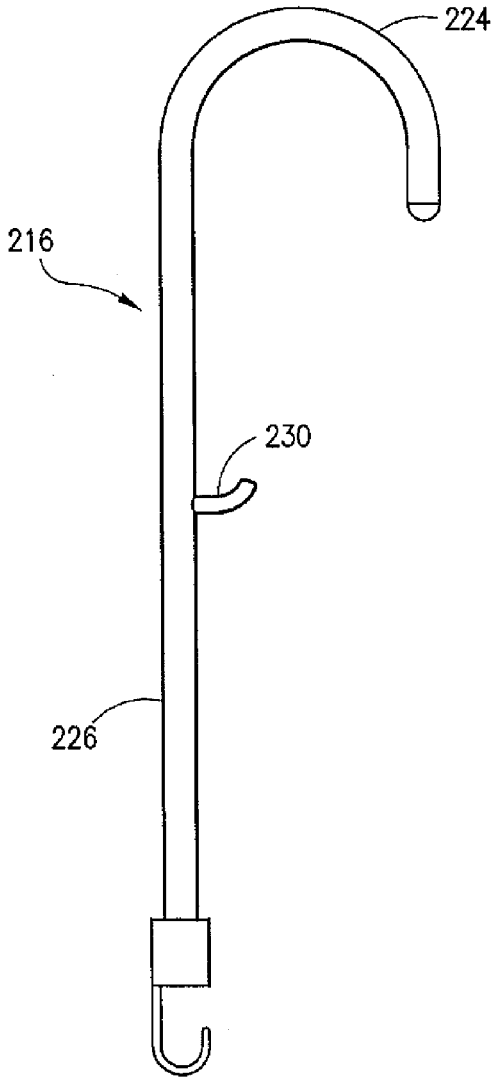
FIG. 13 is a perspective view of the hook in a retracted position.
Figure 14:
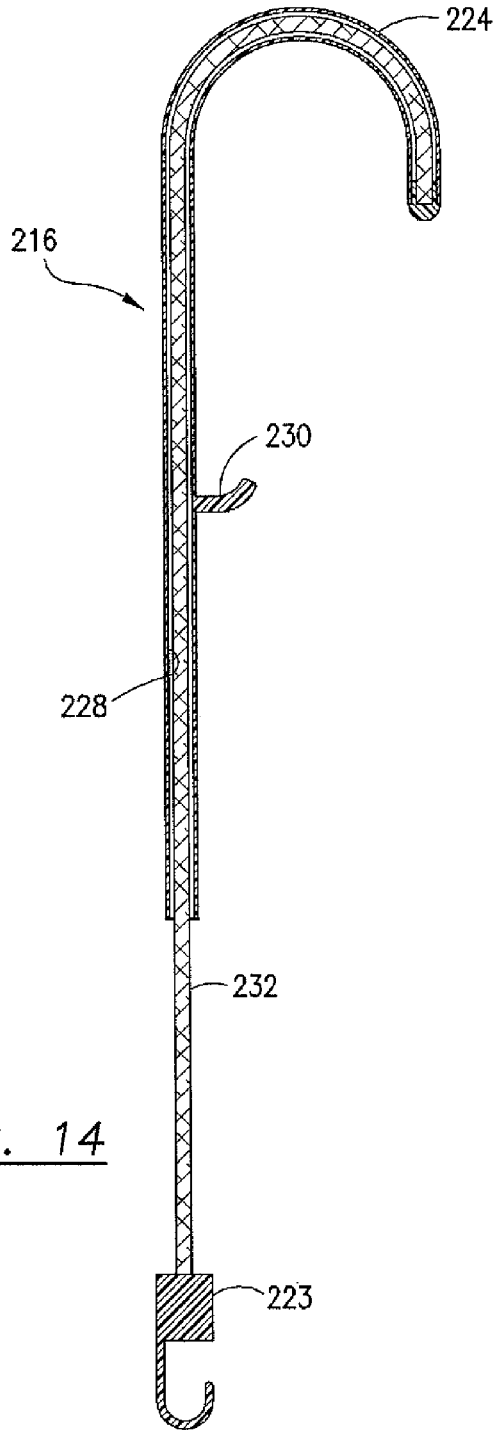
FIG. 14 is a cross sectional view of the hook in an extended position.

Referring now to FIGS. 13 and 14, the hooks 216 employed with the soccer training device are shown in more detail. Each of the hooks 216 comprises a length of plastic or similar material having a curved end 224, a substantially straight leg section 226 and a hollow interior 228. A finger 230 extends outwardly from the leg section 226 as shown. In the presently preferred embodiment, a cord 232 formed of an elastic material, such as a bungee cord, is positioned within the hollow interior 228 with one end affixed to the curved end 224 and the opposite end connected to a fastener 223. The cord 232 is movable between a retracted position shown in FIG. 13 and an extended position depicted in FIG. 14.

The purpose of the cord 232 in the hooks 216 is to facilitate mounting of the net 200 to the goal. Initially, the curved end 224 of each hook 216 may be placed over the cross bar 31. The cord 232 is then extended by grasping the fastener 223 and pulling downwardly so that the fastener 223 may be placed into an eyelet 212 on the top strap 202 of the net 200. After the fastener 223 is in place, the cord 232 may be released allowing it to move from the extended position shown in FIG. 14 toward the retracted position of FIG. 13 thus exerting tension on the net 200 to hold it taught. This feature of the present invention is especially helpful for those of smaller stature to help them more easily mount the net 200 to the goal.

Figure 12:
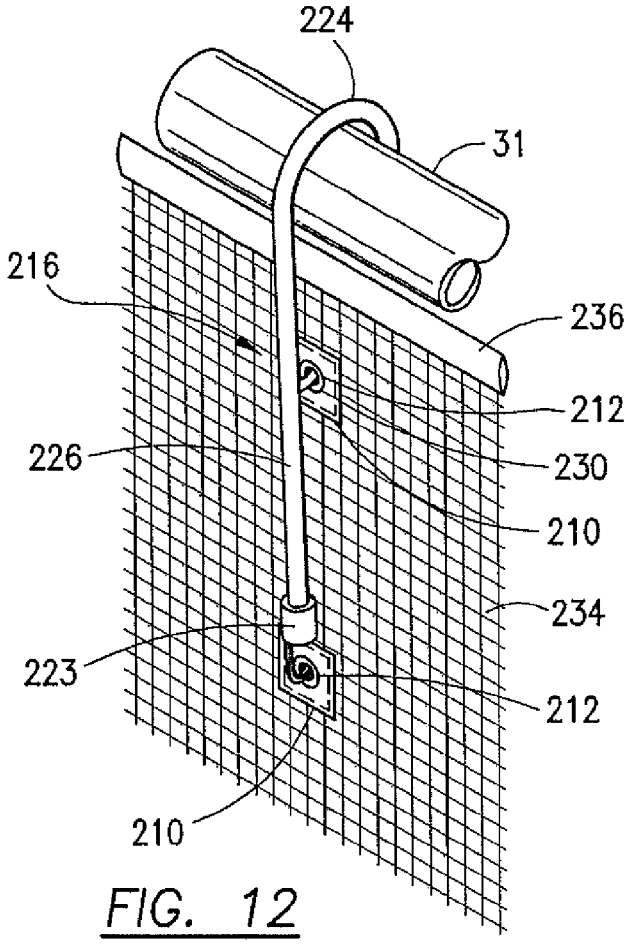
FIG. 12 is a perspective view of a hook connected to the cross bar of the goal and to the net.
Figure 15:
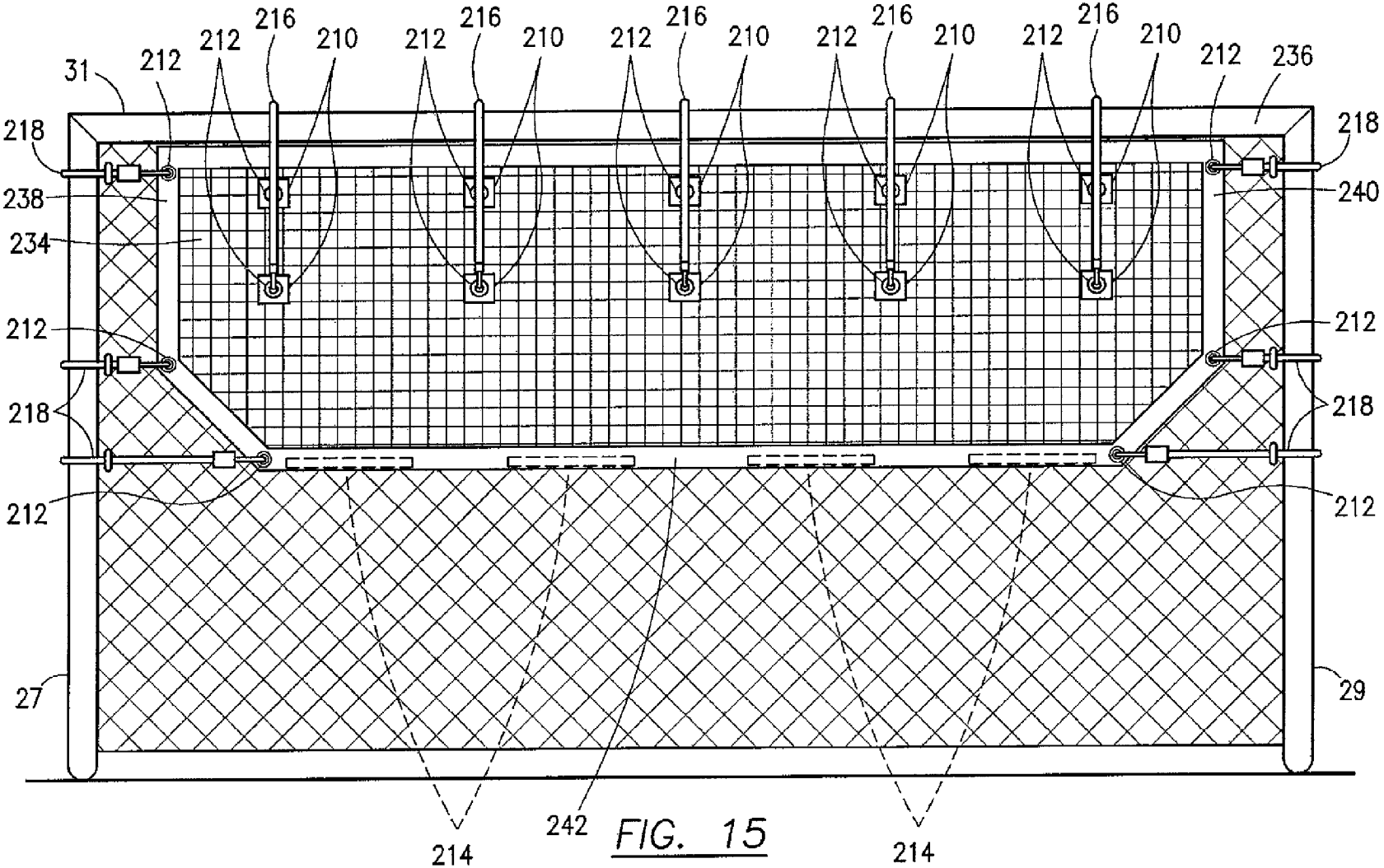
FIG. 15 is a front view of another embodiment of the soccer training device of this invention in a first deployed position.
Figure 16:
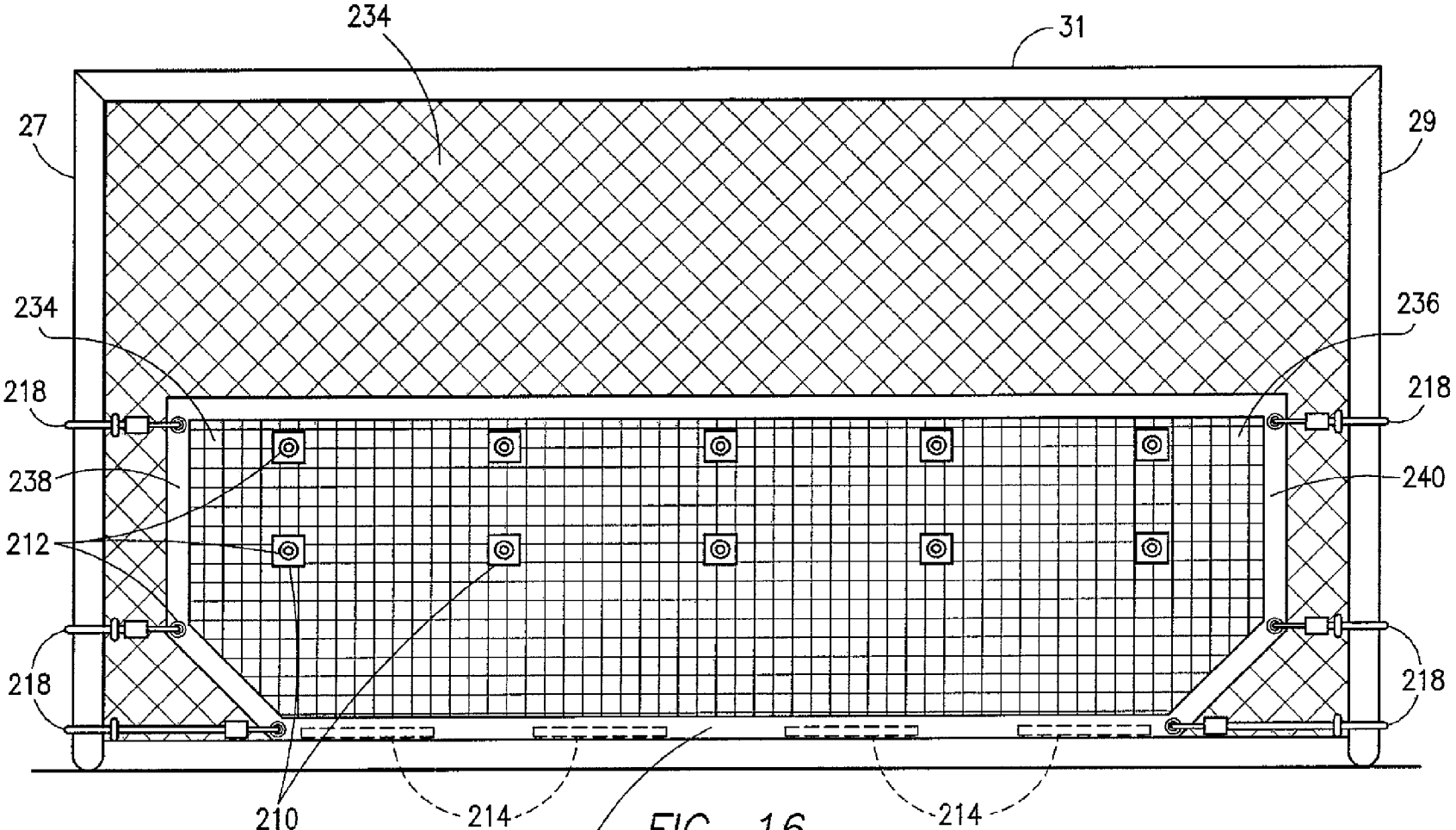
FIG. 16 is a view similar to FIG. 15 except with the net in a second deployed position.

Referring now to FIGS. 12, 15 and 16, a still further embodiment of the soccer training device of this invention is shown. Soccer coaches have different training methods and ideas of how best to execute a penalty kick or other free kick. Some coaches teach players to aim only toward the bottom portion of the goal opening 26 in order to avoid kicking the ball over the cross bar 31. Others train players to aim at points both higher and lower relative to the goal opening 26. The device depicted in FIGS. 12, 15 and 16 comprises a net 234 which has approximately one-half of the height dimension of the goal opening 26. The net 234 includes a top strap 236, opposed side straps 238, 240 and a bottom strap 242. The straps 236-242 may be the same as described in connection with a discussion of FIG. 9, and weights 214 as noted above may be positioned within the bottom strap 242.

In this embodiment of the invention, the net 234 is movable between a raised position shown in FIG. 15 and a lowered position illustrated in FIG. 16. With the net 234 in the raised position, the top strap 236 is located immediately adjacent to the cross bar 31 and the bottom strap 242 is positioned approximately in the center of the side posts 27, 29. In the lowered position, the bottom strap 242 is near or touches the playing surface 24 and the top strap 236 is located at about the center of the side posts 27, 29. As is apparent, different target areas are provided depending on whether the net 234 is in the raised or lowered position. The soccer ball is not permitted to pass into the goal opening 26 between the top strap 236 of the net 234 and the cross bar 31 when in the raised position, or between the bottom strap 242 of the net 234 and the playing surface 24 when in the lowered position.

The net 234 is held in the raised position by hooks 216 and connectors 218, and in the lowered position by connectors 218 alone. Preferably, a number of patches 210 each having a coupler in the form of an eyelet 212 are affixed to the net 234 in spaced pairs. An upper patch 210 and eyelet 212 of each pair is positioned near the top strap 236, and a lower patch 210 and eyelet 212 of such pair is located vertically below the upper one. A number of eyelets 212 are also mounted to each of the side straps 238 and 240 of the net 234. As best seen in FIG. 12, the upper eyelet 212 of each pair receives the finger 230 of a hook 216 and the lower eyelet 212 of each pair receives the fastener 223 at the bottom of the cord 232. It is contemplated that to affix the net 234 to the goal, the finger 230 of each hook 216 is first inserted into an upper eyelet 212 and then the curved end 224 of the hook 216 is extended over the cross bar 31. The fastener 223 connected to the cord 232 of the hook 216 may then be inserted into the lower eyelet 212 of each pair. The connectors 218 are attached to the eyelets 212 on the side straps 238, 240 of net 234 in the same manner described above in connection with a discussion of FIG. 9.

As seen in FIG. 16, in order to move the net 234 from its raised position to the lowered position the hooks 216 are removed. The net 234 may be moved relative to the side posts 27, 29 with the connectors 218 attached, or the connectors 218 may be removed and reattached when in the lowered position. The sole means of attachment of the net 234 to the goal in the lowered position is provided by the connectors 218.

Figure 17:
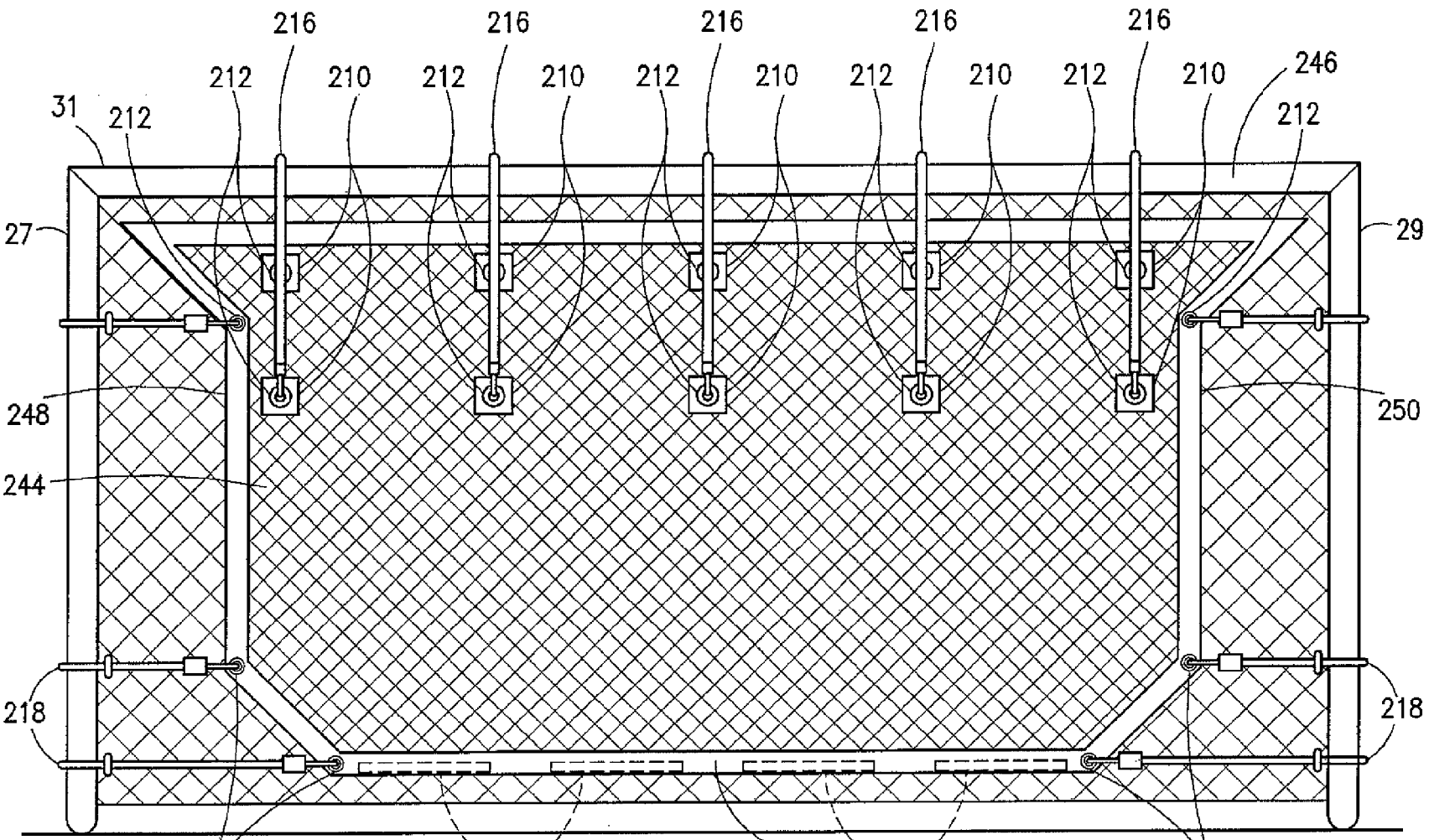
FIG. 17 is a view of still another embodiment of the soccer training device herein.

Referring now to FIG. 17, a still further embodiment of the soccer training device of this invention is illustrated. In this device, a net 244 is provided having a height dimension which, when assembled on the goal, does not permit a soccer ball to pass into the goal opening 26 either at the top or the bottom. The net 244 includes a top strap 246, opposed side straps 248, 250 and a bottom strap 252 which may mount weights 214 as discussed above in connection with FIG. 9. Each side strap 248, 250 has spaced eyelets 212 which receive the fastener 223 of a connector 218 secured to a side post 27 or 29. Hooks 216 are mounted to pairs of upper and lower eyelets 212 in the same manner described in connection with a discussion of FIGS. 12, 15 and 16.

While several particular forms of the invention have been illustrated and described, it will also be apparent that various modifications can be made without departing from the scope of the invention. For example, a flat board, a continuous sheet material, or fabric can be used cover strategic portions of the goal instead of or in addition to a net. As a further example, the goal blocking surface area can be scaled down to a smaller size for youth soccer play. In yet a further example, the leg members can be adjustable in length to allow the vertical gap between the net and the soccer field to be altered as desired. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

The invention claimed is:

1. A coupling device, comprising:

a generally J-shaped housing having an end section and a leg section collectively defining a hollow interior, said end section being positionable over a first member so that said leg section extends in a direction away from said first member;

an elastic member at least partially disposed within said hollow interior of said housing, said elastic member having an inner end connected to said housing and an outer end protruding from said hollow interior of said housing which is capable of connecting to a second member;

said elastic member being moveable between a retracted position in which said outer end is located proximate to said housing and an extended position in which said outer end is spaced from said housing, said elastic member when in said extended position exerting a force on the first and second members in a direction toward one another.

2. The coupling device of claim 1 in which said housing is formed of a rigid plastic material.

3. The coupling device of claim 1 in which said elastic member is a bungee cord.

4. The coupling device of claim 1 further including a finger extending outwardly from said leg section of said housing.

5. A coupling device, comprising:

a generally J-shaped housing having an end section and a leg section collectively defining a hollow interior, said end section being positionable over a first member so that said leg section extends away from the first member;

an elastic member at least partially disposed within said hollow interior of said housing, said elastic member having an inner end connected to said housing and an outer end;

a fastener connected to said outer end of said elastic member and protruding from said hollow interior of said housing, said fastener being effective to engage a second member;

said elastic member being moveable between a retracted position in which said fastener is located proximate to said housing and an extended position in which said fastener is spaced from said housing, said elastic member when in said extended position being effective to exert a force on the first and second members in a direction toward one another.

6. The coupling device of claim 5 further including a finger extending outwardly from said leg section of said housing.

7. The coupling device of claim 6 in which said finger is effective to engage the second member at a different location than where said fastener engages said second member.

8. The coupling device of claim 5 in which said housing is formed of a rigid plastic material.

9. The coupling device of claim 5 in which said elastic member is a bungee cord.

* * * * *